US007934445B2

(12) United States Patent
McClellan

(10) Patent No.: US 7,934,445 B2
(45) Date of Patent: May 3, 2011

(54) COMBINATIONS OF PROTECTIVE BALLISTIC WEAPONS STANDS AND WEAPON TRIPODS

(75) Inventor: Dale A. McClellan, Virginia Beach, VA (US)

(73) Assignee: Special Tactical Services, LLC., Virginia Beach, VA (US)

( * ) Notice: Subject to any disclaimer, the term of this patent is extended or adjusted under 35 U.S.C. 154(b) by 636 days.

(21) Appl. No.: 11/491,902

(22) Filed: Jul. 25, 2006

(65) Prior Publication Data

US 2010/0218668 A1 Sep. 2, 2010

Related U.S. Application Data

(63) Continuation-in-part of application No. 11/114,232, filed on Apr. 26, 2005, now Pat. No. 7,243,590, which is a continuation-in-part of application No. 10/445,776, filed on May 27, 2003, now Pat. No. 7,051,637.

(51) Int. Cl.
*F41A 23/12* (2006.01)

(52) U.S. Cl. ..... 89/40.06; 89/36.06; 89/36.04; 89/37.02

(58) Field of Classification Search ..... 89/36.06, 89/36.15, 36.04, 37.02, 37.03, 40.06
See application file for complete search history.

(56) References Cited

U.S. PATENT DOCUMENTS 295,013 A 3/1884 Hunter
774,223 A 11/1904 Wilson
1,146,428 A * 7/1915 Jacob ..... 89/200
1,233,165 A * 7/1917 Barry ..... 89/11
1,290,606 A 1/1919 Lovas
1,301,293 A 4/1919 Molvig
1,323,433 A 12/1919 Alexander
1,555,027 A 9/1925 Rose
1,611,814 A 12/1926 Butler
2,215,204 A 9/1940 Young
2,306,708 A 12/1942 Mendel
2,345,740 A * 4/1944 Fogle ..... 89/37.03
(Continued)

*Primary Examiner* — Stephen M Johnson
(74) *Attorney, Agent, or Firm* — Millen, White, Zelano & Branigan, P.C.

(57) ABSTRACT

Fixed weapon emplacements include ballistic weapon stands having heights sufficient to protect standing gunners in combination with tripods, which are fixed thereto with welded connections. In a first embodiment, the tripod has two legs fixed to a weapon platform and to the base of the ballistic weapons stand and a third leg fixed to the weapon platform and to a weld plate on a front armor plate of the stand. In a second embodiment, the third leg of the tripod is provided by a strut that extends through a slot in the front armor plate and is welded to both a weld plate behind the front armor plate and to the weapon platform. In a third embodiment, the tripod has one leg fixed to the base of the weapon stand and two legs welded to a weld plate behind the front armor panel to support the weapon platform. In a fourth embodiment, a hood projects from the front armor plate with a front leg of the tripod fixed to the base at a location within the hood and rear legs of the tripod fixed to the base. A universal base is provided wherein either a single leg of the tripod is attached to the base adjacent to the front armor plate or a pair of legs of the tripod is attached to the same base adjacent to the front armor plate. In any of the embodiments the weapon platform at the top of the tripod is mounted on the tripod by utilizing three sleeves that receive top portions of three straight legs of the tripod.

26 Claims, 13 Drawing Sheets

U.S. PATENT DOCUMENTS 2,415,340 A * 2/1947 D Ardenne et al. ..... 89/37.03
4,358,984 A 11/1982 Winblad
4,412,495 A 11/1983 Sankar
4,497,515 A 2/1985 Appelson
4,673,609 A 6/1987 Hill
4,674,394 A 6/1987 Martino
4,812,031 A 3/1989 Evans
5,767,933 A 6/1998 Hagan
5,773,110 A 6/1998 Shields
5,925,437 A 7/1999 Nelson
5,936,550 A 8/1999 McCauley
6,030,687 A 2/2000 Andriash
6,133,856 A 10/2000 McCauley
6,258,429 B1 7/2001 Nelson
6,487,807 B1 12/2002 Kopmann
6,872,435 B2 3/2005 Bull et al.
7,051,367 B1 5/2006 Clark et al.
7,243,590 B2 * 7/2007 McClellan et al. ..... 89/36.06
2005/0188596 A1 9/2005 Wygant
2005/0188597 A1 9/2005 Keng
2005/0217472 A1 10/2005 Baker
2006/0086242 A1 4/2006 Clark

* cited by examiner

COMBINATIONS OF PROTECTIVE BALLISTIC WEAPONS STANDS AND WEAPON TRIPODS

RELATED PATENT APPLICATIONS

This application is a continuation-in-part of U.S. patent application Ser. No. 10/445,776, filed May 27, 2003, now U.S. Pat. No. 7,051,637, for "Modular Armor Shield Assembly" which is incorporated herein in its entirety, which is a continuation-in-part of U.S. patent application Ser. No. 11/114,232, filed Apr. 26, 2005, now U.S. Pat. No. 7,243,590, for Protective Ballistic Weapons Stands And Transparent Shields Usable Therewith, also incorporated herein in its entirety.

FIELD OF THE INVENTION

The present invention relates to combinations of protective ballistic weapon stands and tripods. More particularly, the present invention relates to protective ballistic weapon stands that are used for fixed weapon emplacements on ships, vehicles, air-supported vehicles, and at stationary locations (such as but not limited to entry control points and fighting positions). Moreover, the invention relates to weapons tripods in combination with such protective ballistic weapon stands.

BACKGROUND OF THE INVENTION

Soldiers, sailors, marines and security personnel operating fixed weapon emplacements which may include weapons, such as but not limited to: the M2HB .50 caliber Machine Gun, MK43 Mod 1 7.62 mm Machine Gun, M240 7.62 mm Machine Gun, M249 5.56 mm Machine Gun, MK48, MK46 weapons, or to weapon mounts and cradles to include but not be limited to the MK16 stand, MK82, MK93, MK95, MK97 and MK125 and to all modifications related to these types of stands and cradles. Positions including these and other weapons may all be exposed to incoming bullets and shrapnel. It is desirable to shield these gunners from incoming fire with minimal compromise to their effectiveness.

There is a need for protective ballistic weapon stands used for fixed weapon emplacements, wherein the ballistic stands protect gunners from incoming bullets and shrapnel while providing support for a weapon or a number of weapons. A standard practice is to mount weapons on tripods to provide adequate three-point support, but to date the advantages of tripods, especially for weapons fired while standing, have not been integrated with the advantages provided by ballistic weapons stands.

SUMMARY OF THE INVENTION

A fixed weapon emplacement comprises a ballistic weapons stand wherein the weapons stand has a height sufficient to at least partially protect a standing gunner. The ballistic weapons stand includes a base plate and at least one front armor plate extending vertically from the base plate at an obtuse angle with respect thereto. The front armor plate has a vertically extending brace welded at a bottom end thereof to the base plate and secured to the vertically extending armor plate by a weld plate to brace the armor plate. A three-point weapon support in combination with the ballistic weapons stand has a platform for mounting a weapon thereon. The three-point weapon support has at least one leg fixed to the base and at least one leg fixed to the weld plate behind the front armor plate, with a third leg fixed to either the base or the weld plate.

In a further aspect of the emplacement, the three-point support is a tripod with a first leg fixed to the base and second and third legs fixed to the weld plate behind the front armor plate.

In a further aspect of the emplacement the three-point support is a tripod with first and second legs fixed to the base and a third leg fixed to the weld plate behind the armor plate.

In still a further aspect of the emplacement, the three-point support comprises two rear legs fixed to the base and a front leg provided by a flange which projects through and back from the weld plate and the armor plate and is fixed to the weapons platform.

In still a further aspect of the emplacement, the three-point support is a tripod with a front leg positioned within a hood extending forward of the front armor plate and a pair of rear legs secured to the base.

In another aspect of the emplacement, the armor panel is in an arrangement which includes at least two additional armor panels disposed angles to the front armor panel to form a concave protective space for the gunner and a front convex projectile deflecting surface.

In a further aspect of the emplacement, the emplacement utilizes a universal base allowing either a single leg of the tripod of a pair of legs of the tripod to be secured either forward or aft on the base.

In a further aspect, the weapons mounting platform on the top of the tripod has three sleeves extending downwardly therefrom for receiving top portions of the legs of the tripod.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
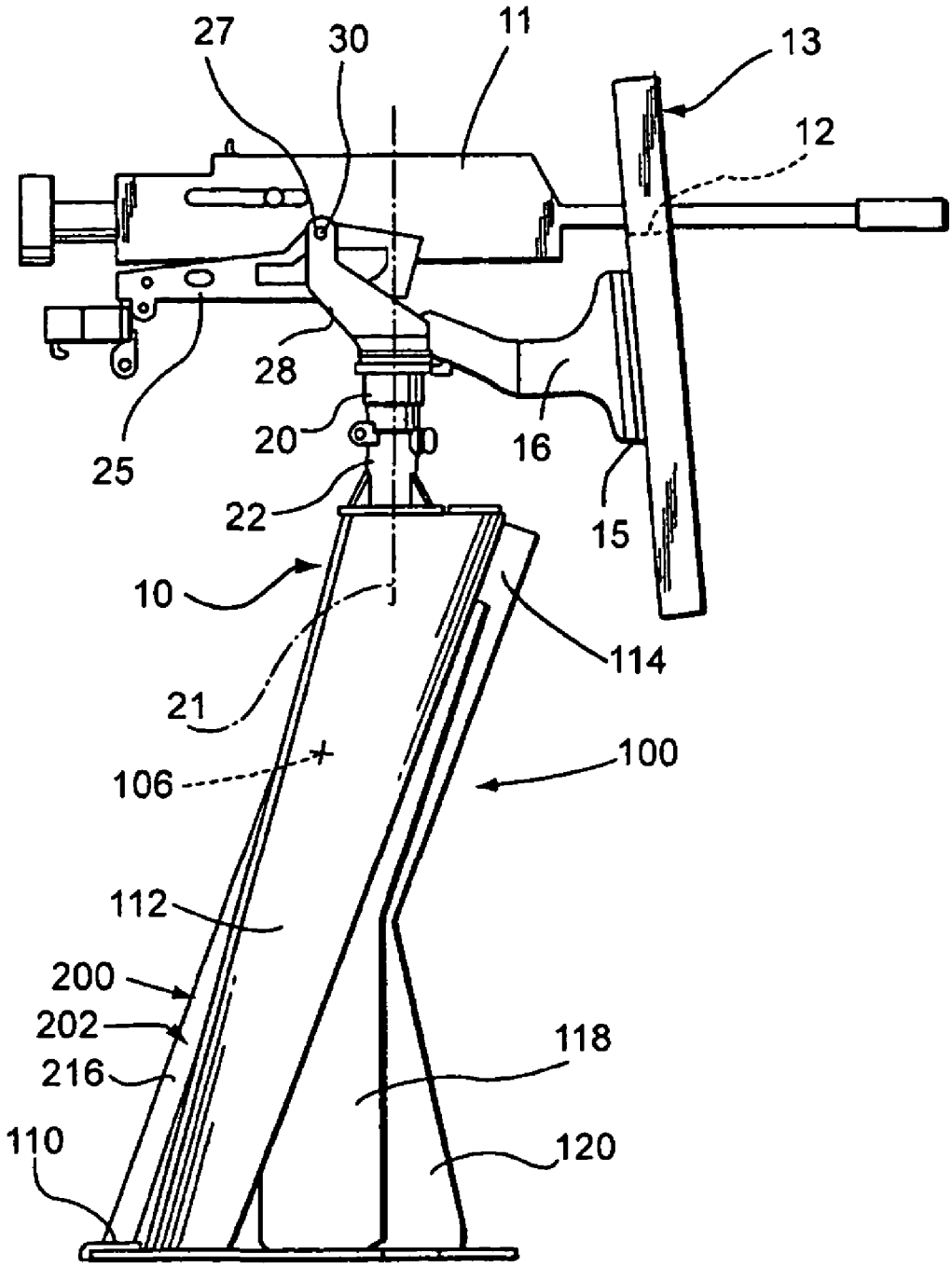
FIG. 1 is a side view of a fixed weapon emplacement in combination with a tripod and transparent shield.
Figure 3:
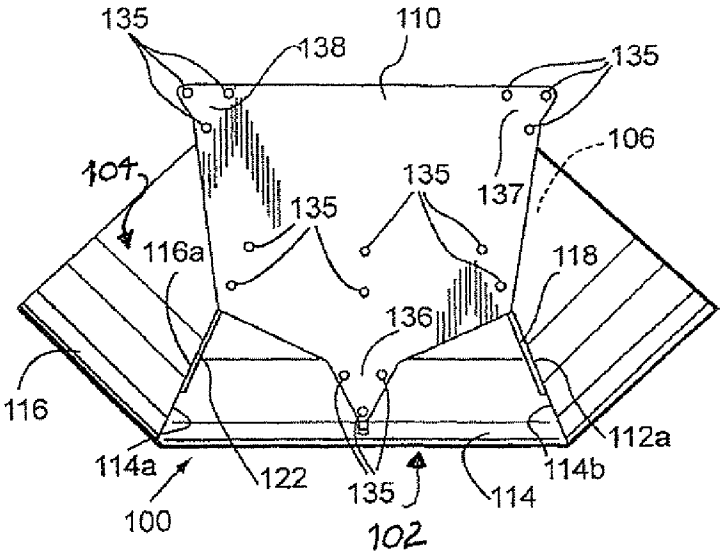
FIG. 3 is a bottom view of the fixed weapon emplacement of FIGS. 1 and 2.
Figure 2:
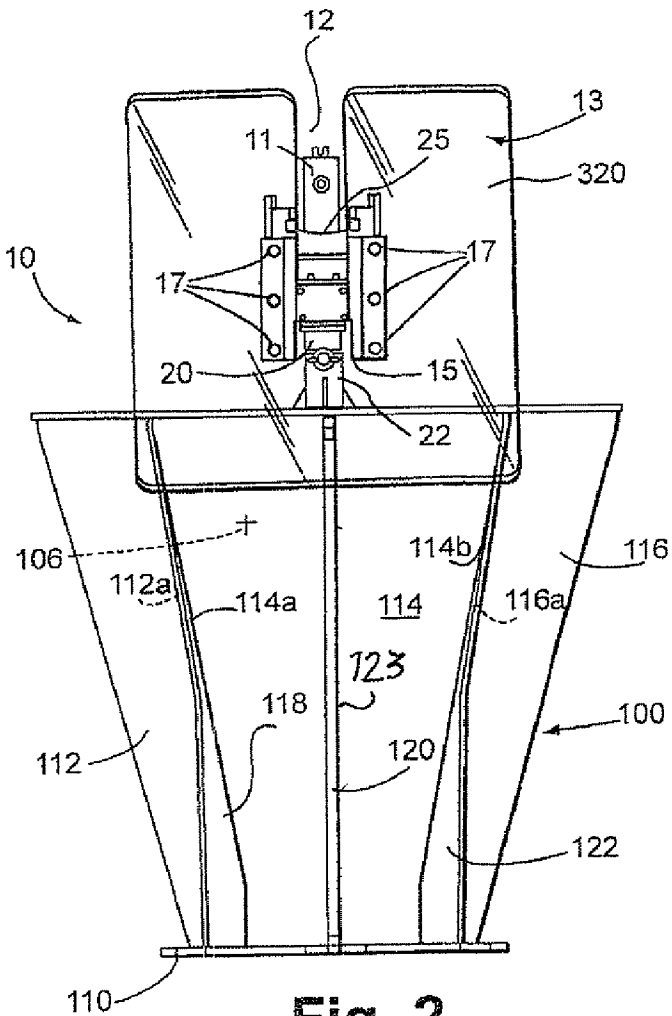
FIG. 2 is a front view of the fixed weapon emplacement of FIG. 1.

Referring to FIGS. 1-3, there is shown a fixed weapon emplacement 10 having a weapon, such as a machine gun 11, mounted thereon that projects through a slot 12 in a transparent shield 13. The transparent shield 13 is made of a transparent material capable of defeating projectiles such as bullets or shrapnel which might otherwise wound or kill a gunner standing behind the shield. The transparent shield 13 enables a gunner to see through the shield while protecting the gunner from incoming fire. The transparent shield 13 comprises at least one panel of projectile-resistant material, such as but not limited to, projectile-resistant glass in the form of a laminate comprising glass, polycarbonate and polyurethane. In one embodiment, the glass is chemically treated so that the gunner can see out of the emplacement 10 but an adversary cannot see the gunner.

The bracket 16 is rigidly fixed to a swivel 20 that is mounted to pivot about a vertical axis 21 on a stand 22. Consequently, the transparent shield 13 may swivel with the gun 11 about the vertical axis 21. When it is necessary to elevate the gun 11, the transparent shield 13 remains fixed with respect to the vertical and the gun 11 elevates and lowers within the slot 12. Elevation of the gun 11 is accomplished by a gun cradle 25, which mounts the gun on the swivel 20 to pivot the gun about a horizontal axis 27. The swivel 20 has a pair of flanges 28 that project upwardly therefrom and which receive pivots 30 coaxial with the axis 27. The pair of flanges 28, swivel 20 and mounting bracket 16 pivots in unison about the axis 27 so that the weapon sweeps with relative ease. The transparent shield 12 is relatively lightweight so that any inertial interference with aiming the gun 11 is minimized. The gun 11 is also substantially balanced at the axis 27 allowing the gunner easily to elevate the gun 11 in the slot 12 independently of the sweep position of the gun and shield 13.

Figure 4:
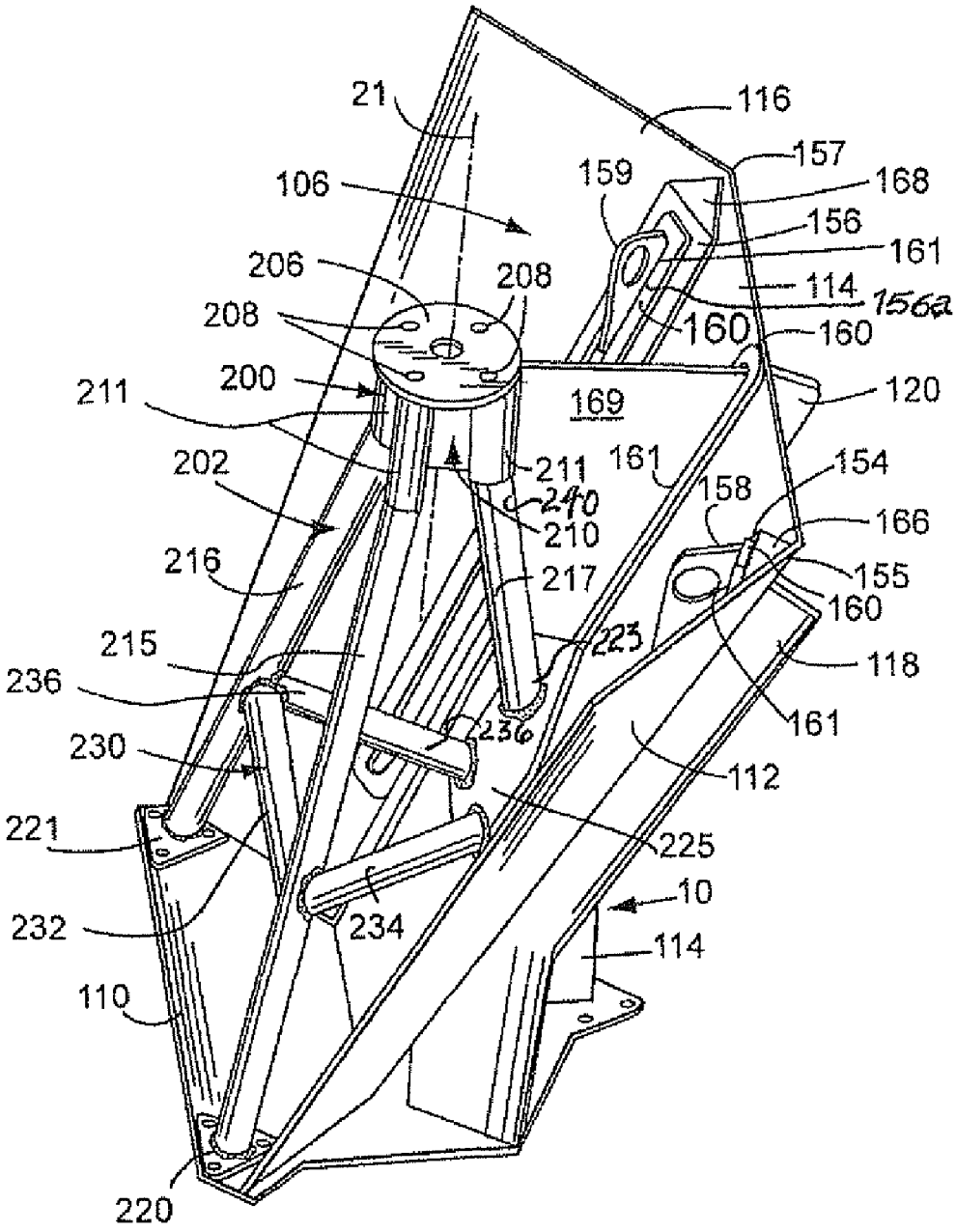
FIG. 4 is a top perspective view from the rear and side of the fixed weapon emplacement of FIGS. 1-3, illustrating a first embodiment of the emplacement.
Figure 5:
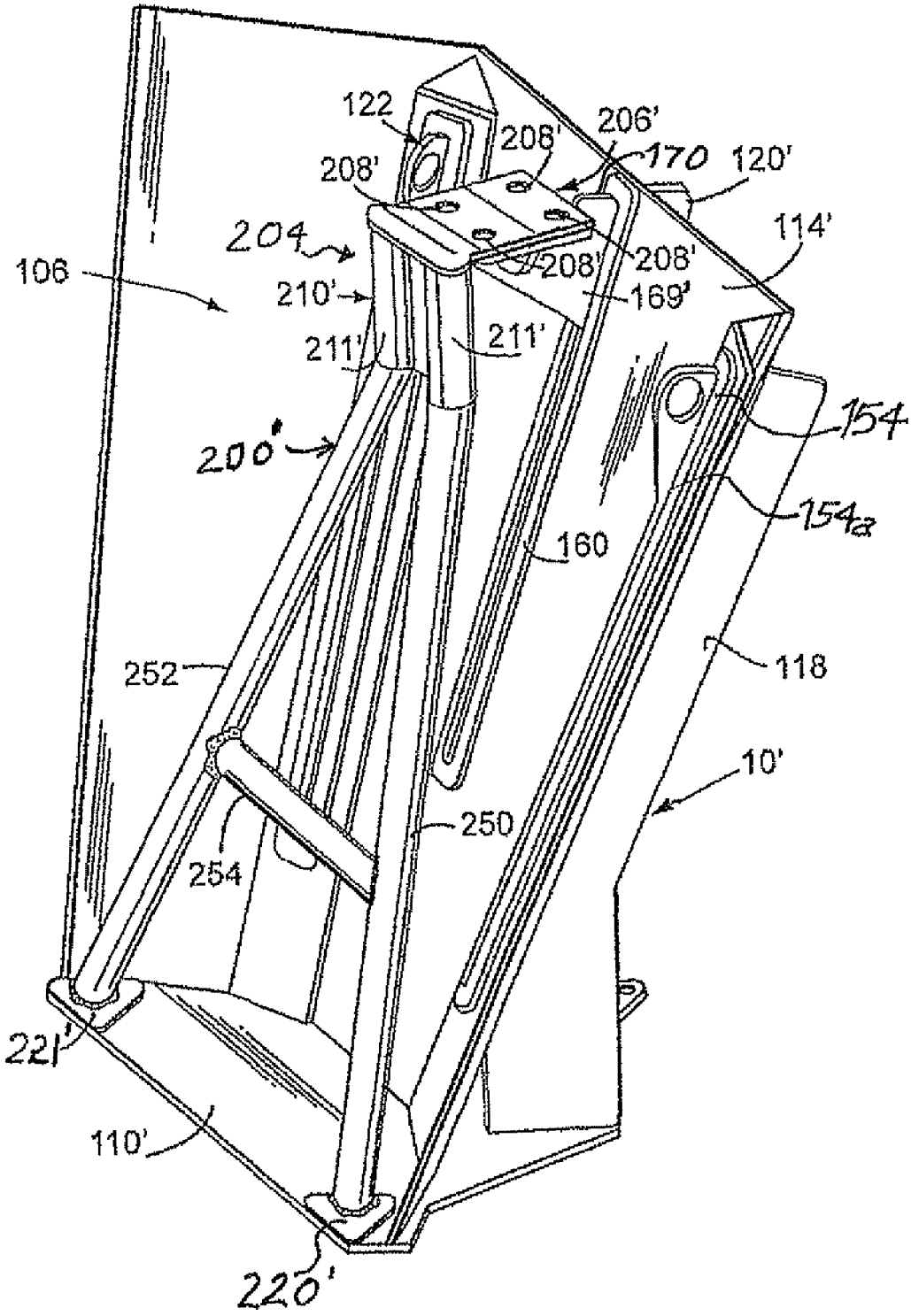
FIG. 5 is a perspective view from the rear side of a ballistic weapons stand and tripod according to a second embodiment of the fixed weapon emplacement.

The fixed weapon emplacement 10 discussed thus far with respect to FIGS. 1-3 also comprises a ballistic weapons stand 100 shown in FIGS. 1-3, as well as in FIGS. 4-10. The ballistic weapons stand 100 has a height sufficient to protect a standing gunner and is in combination with a three point gun support 200 for mounting the weapon 11 shown in FIGS. 1 and 2. The three-point gun support 200 is configured as a tripod 202, best shown in FIGS. 4, 6 and 7-10, or as a supported bipod 204 with a supporting flange providing a third leg as is shown in FIG. 5. The embodiments of the invention optionally include the aforementioned transparent shield 13 in combination therewith.

The ballistic weapons stand 100 has a convex front area 102, which faces assailants, and a concave rear area 104, which faces a protected space 106. The ballistics stand 100 includes a base 110 having an array of armor panels 112, 114 and 116 welded thereto and extending upwardly therefrom at an angle in the range of 10° to 30°, and preferably about 20°, with respect to the vertical so as to deflect bullets and shrapnel downwardly toward the base and toward whatever platform to which the base is secured. The armor panels 112-116 are made of AR500 Lear armor plate steel or armor plate tempered to military specifications. The base 110 may be located at an anti-terrorism or force protection location, at a fighting position, or installed at an entry control point, or the base may be secured on the deck of a ship, which could be any type of ship including a relatively small patrol boat. Other locations at which the ballistic weapon stands 100 are used are guard towers located around guard shacks.

In order to stiffen the armor panels 112, 114 and 116, vertically extending struts 118, 120 and 122 form braces that are welded to and extend upwardly from the base 110. The struts 118, 120 and 122 are preferably made of armored steel, such as but not limited to AR500 Lear armor plate. The first strut 120 projects through a laser cut slot 123 in armor panel 114 back into the protected space 106 of the ballistic weapon stand 100. The first strut 120 has a dimension in front of the slot 123, which is greater than the slot 123 so than only a rear portion 169 (see FIGS. 4-7) projects through the slot 123. Thus, the armor panel 114 is braced at its front surface. The slot 123 could be formed in other ways, such as but not limited to, casting. It is only important that forming of the slot not substantially degrade the temper of the armor panel.

In order to minimize degradation to the ballistic integrity of the armor panels 112, 114 and 116, there are no welds on the faces of the panels. The edges 114*a* and 114*b* of panel 114 are unwelded, while the edges 112*a* and 116*a* of the armor panels 112 and 116 are welded with stitch welds to the sides of the first strut 118 and third strut 122, respectively. The stitch welds have gaps therebetween. This arrangement provides vertical support for the armor panels 112, 114 and 116 of the ballistic weapons stand 100 on the base 110 without having welds on the front or rear faces or the edges 114*a* and 114*b* of armor panel 114. Only the edges 112*a* of armor panel 112 and 116*a* of armor panel 116 have welds and these are stitch welds with gaps that minimize and localize changes in temper to the armor panels 112 and 116.

The base 110 has holes 135 therein for receiving bolts to anchor the base to a support on the ground, building platform or ship deck. At least some of the holes 135 are located in triangular projections 136, 137 and 138 at the front and rear edges of the base. This arrangement anchors the ballistic weapons stand 110 outboard of the lower periphery of the stand as defined by the lower edges of the armor panels 112, 114 and 116. The base is also anchored by bolts through holes 135 within the protected space 106 shielded by the armor panels 112, 114 and 116. Since the bottom edges of the armor panels 112, 114 and 116 are attached by welding to the base 110, interference with temper is this limited to small edge portions of the armor panels 112, 114 and 116. Other methods, such as mechanical interlocking or bolting may be utilized, but welding is preferred.

Referring now to drawing FIGS. 4-7, wherein the protected space 106 behind the armor panels 112, 114 and 116 is shown, it is seen in each Figure that a backing plate 154 abuts armor panels 112 and 114 to cover the seam 155 between the armor panels 112 and 114 and a backing plate 156 abuts armor panels 116 and 114 to cover seam 157. The backing plate 154 has a slot 154*a* therein which receives a rear portion 158 of the strut 118 therethrough, while the backing plate 156 has a slot 156*a* that receives a rear portion 159 of the strut 122 therethrough. The backing plates 154 and 156 are also made of armor plate steel and provide back-up armor to the seams, 155 and 157 which are formed by the stitch welds to adjacent edge portions of the armor panels 112 and 116 which have had changes in temper due to welding. A welding strap 160 with a slot 161 therethrough is placed over backing plate 154 and receives the rear portion 158 of strut 118 therethrough. Spaced stitch welds with gaps therebetween weld the rear portion 158 of the strut 118 to the welding strap 160. A similar weld strap 160 with a slot 161 overlies the backing plate 156 with the rear portion 159 of the gusset 122 projecting therethrough. Spaced stitch welds with gaps therebetween also weld the rear portion 159 to the welding strap 160. In this way, the backing plates 154 and 156 covering the seams 155 and 157 have no welds along their length and provide full hardness temper armor behind the seams 155 and 157. The spaced stitch welds with gaps are staggered with respect to one another on opposite sides of the portions 158 and 159.

At the top of each of the backing plates 154 and 156, there are optionally triangular fillers 166 and 168, respectively, which are welded around the edges thereof to the armor panels 112 and 114 and to the armor panels 116 and 114. Since these welds are adjacent to the top edges of the armor panels and the backing plates, temper is changed in only a very small area of armor.

A third welding strap 160 with a slot 161 therein receives therethrough a triangular rear projector 169 of the strut 120 which projects through the laser cut slot 124 in the panel 114. The third welding strap 160 is also welded with stitch welds to the rear projection 169 of the strut 120. In each embodiment, the triangular rear projection 169, which is unitary with the strut 120 helps support the weapon 11 (FIGS. 1 and 2). The triangular projection 169 passes through the laser cut slot 123 (FIG. 2) in the middle panel 114. By this arrangement, there are no welds in the middle armor panel 114, which might compromise the temper of the middle armor panel. Optionally, an armored backing plate, such as the armored backing plates 154 and 156 may also be placed behind the slot 123 between the middle armor panel 114 and the third welding plate 160, but this is not thought necessary because the laser cut is not thought to substantially alter the temper of the armor plate 114.

Referring now specifically to FIG. 4, where a first embodiment of the combination protective ballistic weapons stand and weapon tripod is shown, the three-point support 200 is configured as a tripod 202 having a weapon platform 206 mounted thereon. The weapon platform 206 has bolt holes 208 for receiving bolts that mount the stand 22 which supports the swivel 20 to which the weapon 11 is mounted (see FIGS. 1 and 2). Fixed to and projecting down from the platform 206 is a tubular bracket 210, having three sockets 211 which receive top portions of first, second and third legs 215, 216 and 217 that form the tripod 202.

The legs 215 and 216 have bottom flanges 220 and 221 that are bolted through the holes 135 in the triangular projections 137 and 138 of the base 110 (see also FIG. 3). The third leg 217 is shorter than the first and second legs 215 and 216 and has an end portion 223 that is welded to a weld back up plate 225, which is part of the welding strap 160 that extends over the slot 123 in the front armor plate 114. Intermediate the ends of the first and second legs 215 and 216, a brace 230 is disposed. The brace 230 has a first tubular bar 232 which is welded at its ends to the first and second legs 215 and 216 and second and third tubular bars 234 and 236 that have first ends welded to the first and second legs, respectively, and second ends welded to the weld plate 225.

The triangular projection 169 has an edge 240, which is welded to the third leg 217 and to the front socket 211 of the bracket 210. Thus a rigid stable, structure is provided for the platform 206 mounting the weapon 11 of FIGS. 1 and 2.

Referring now specifically to FIG. 5, where a second embodiment of the combination is shown, the three point support 200' is comprised of first and second legs 250 and 252 braced by a cross bar 254 and the triangular projection 169' extending back from the front strut 120'. The triangular projection 169' has an upper portion 170 that is welded to a platform 206' on which a weapon, such as the weapon 11 of FIGS. 1 and 2 is mounted. The platform 206' has four bolt holes 208' for receiving bolts from the stand 22 which supports the swivel 21 on which the weapon 11 is mounted (see FIG. 1). The platform 206' has a bracket 210' integral therewith which has two sockets 211' that receive top ends of the legs 250 and 252, the bottom ends of the legs having bottom flanges 220' and 221' that are bolted to the base 110'.

Figure 6:
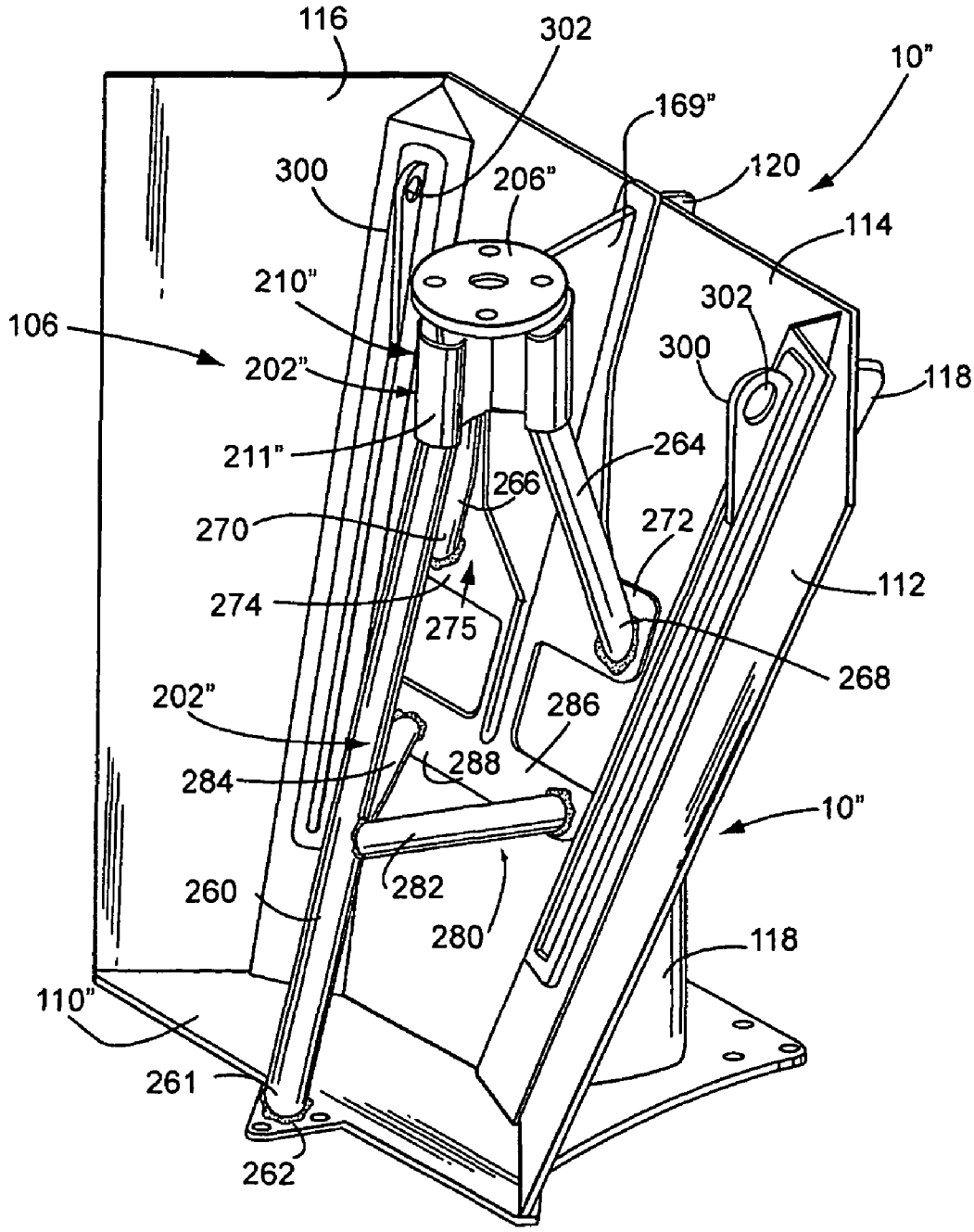
FIG. 6 is a perspective view from the rear side of a ballistic weapons stand and tripod according to a third embodiment of the fixed weapon emplacement.
Figure 7:
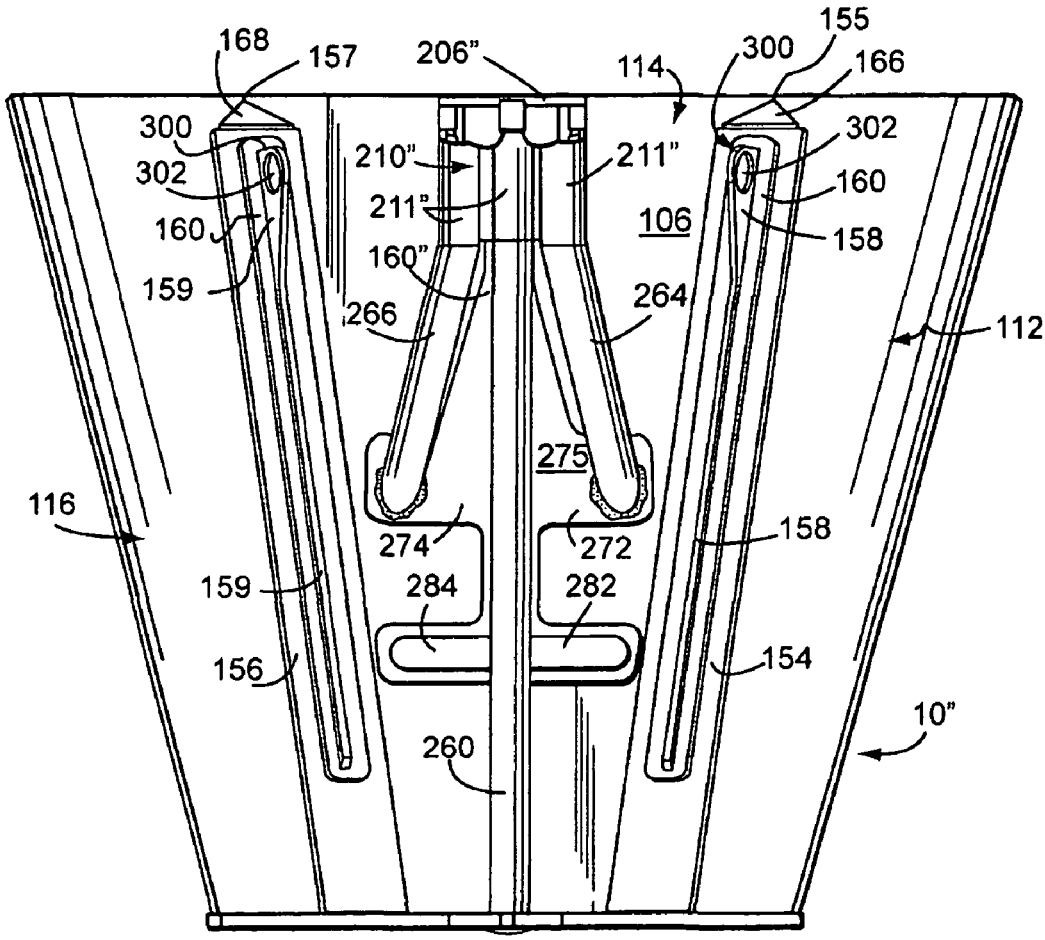
FIG. 7 is a rear view of the fixed weapon emplacement of FIG. 6.

Referring now specifically to FIGS. 6 and 7, where a third embodiment of the combination is shown, the three point support 200" is configured as a tripod having a first leg 260 that has bottom end 261 welded or otherwise fixed to the base 110" on a triangular flange 262 projecting from the base. The first leg 260 has an upper end portion received in a socket 211" of a tubular bracket 210" that is welded to a platform 206" for mounting a weapon 11 (FIG. 1). The tubular bracket 210" also has sockets 211" for receiving the upper ends of second and third legs 264 and 266 that have lower ends 268 and 270 welded to first wings 272 and 274 of a weld pate 275. The projection 169" extending through the slot 124 in the front armor plate 114 is welded to the tubular bracket 210" and/or the platinum 206". The tripod 202" is braced by an angular brace 280 having first and second tubular bars 282 and 284 that are each welded at one end to the first leg 260 and welded at a second end to second wings 286 and 288, respectively, of the weld plate 275. Thus a rigid weapons platform is provided by the combination of tripod 202" and the ballistic weapon stand 100 configuring the fixed weapon emplacement 10".

In each of the embodiments the struts 118 and 122 have flange portions 300 that have lift holes 302 therein which are engageable by hooks (not shown) for lifting the fixed weapon emplacements 10, 10' and 10" by derricks for placement or removal.

Figure 8:
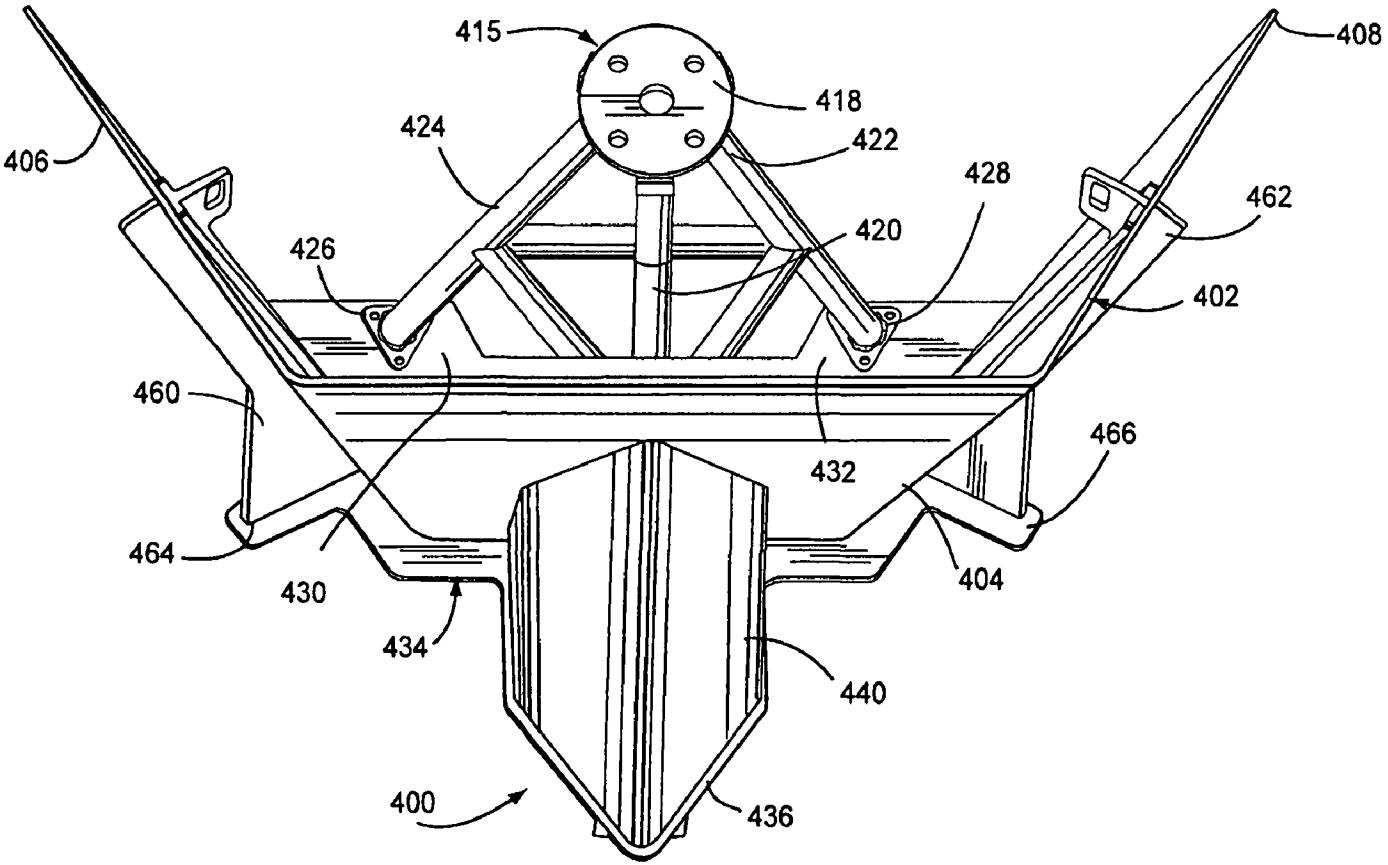
FIG. 8 is a top perspective view of a fourth embodiment of a fixed weapon emplacement with a ballistic weapons stand and tripod as seen from the front.
Figure 9:
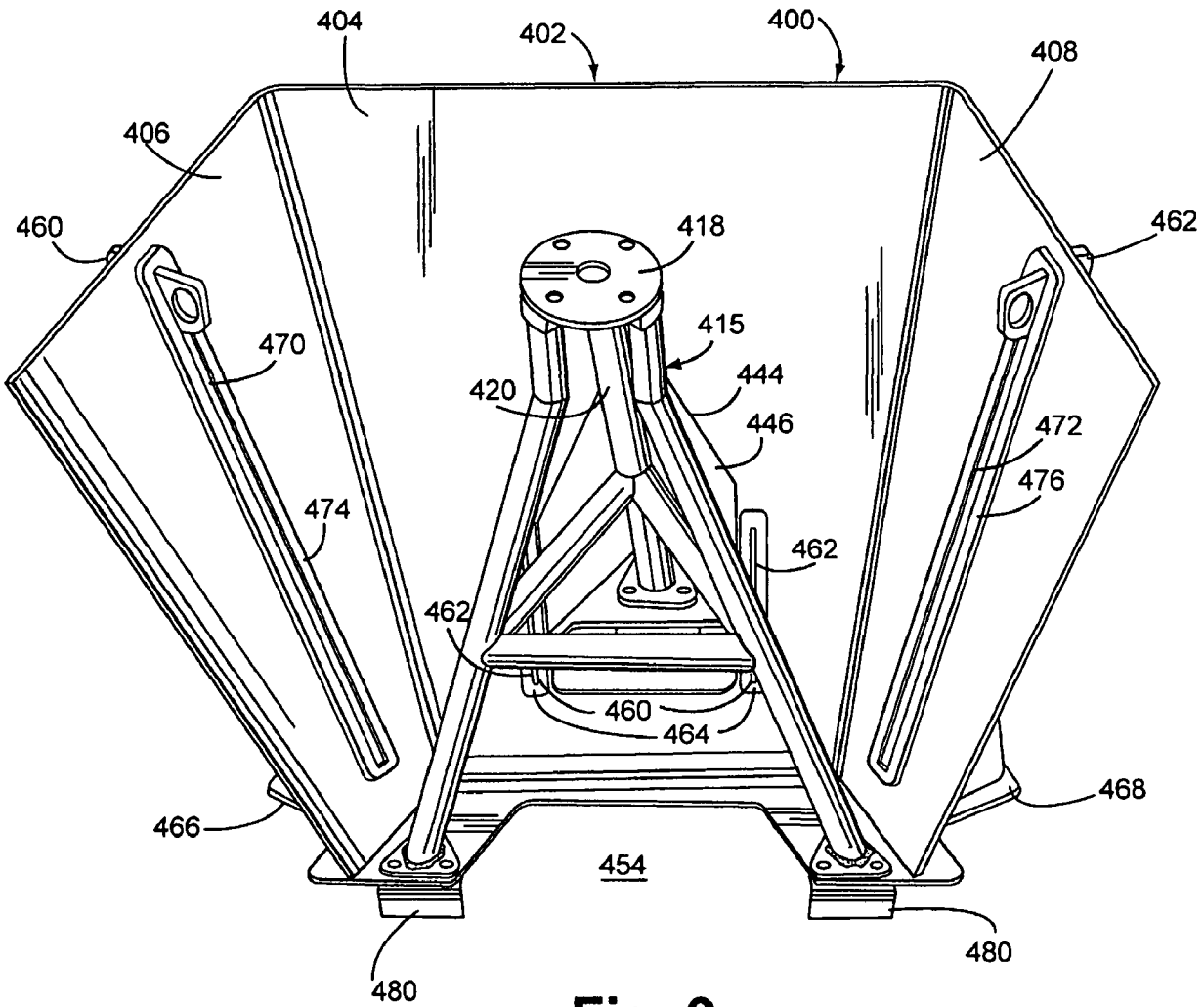
FIG. 9 is a top view of the fixed weapon emplacement of FIG. 8, as seen from the rear.
Figure 10:
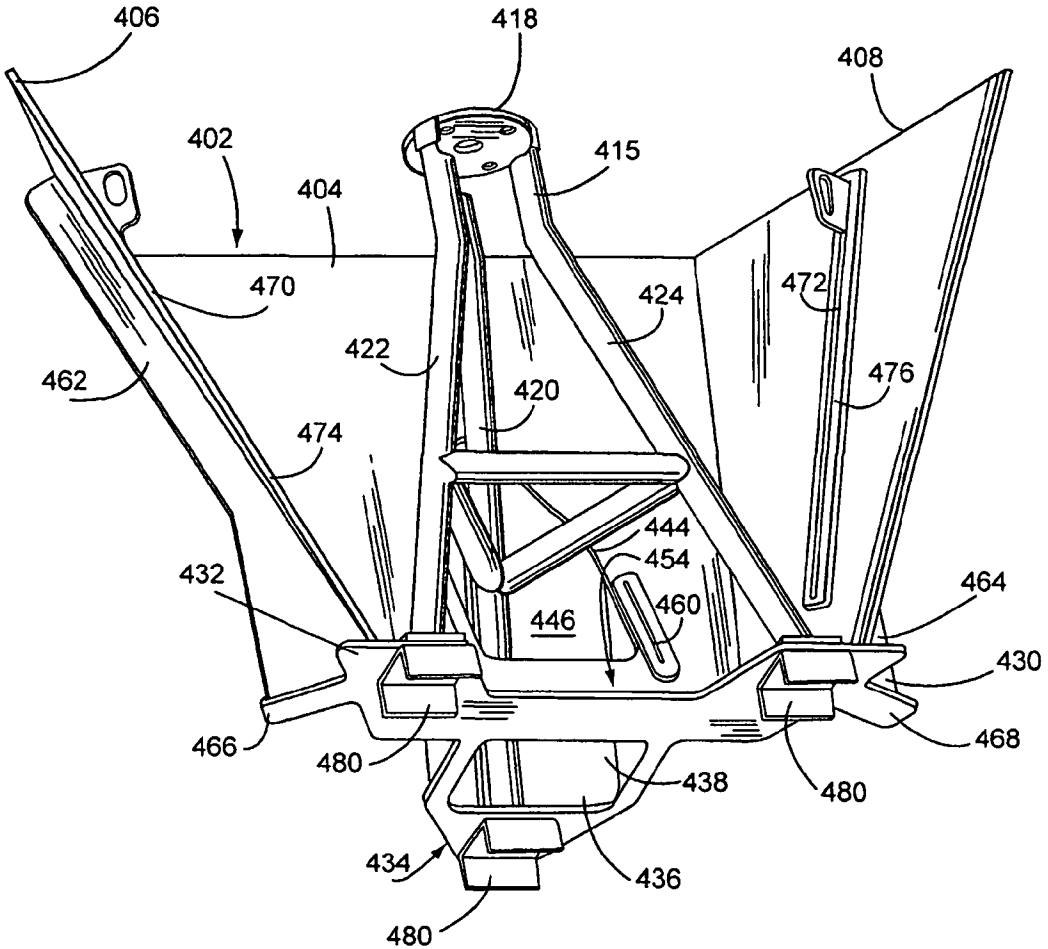
FIG. 10 is a bottom perspective view of the fixed weapon emplacement of FIGS. 8 and 9, as seen from the rear.

Referring now specifically to FIGS. 8-10, there is shown a fourth embodiment 400 of a weapon emplacement according to the present invention, wherein a ballistic weapons shield 402 has a front panel 404 and first and second side panels 406 and 408. The fixed weapon emplacement 402 has in combination therewith a tripod 415 which has a platform 418 for mounting a weapon (11, see FIG. 1) that is supported by a front leg 420 and a pair of rear legs 422 and 421. The rear legs are anchored by bolted flanges 426 and 428 to rear portions 430 and 432 of a base 434. The base 434 has a projecting front portion 436, which extends in front of the front armor plate 404.

An armored hood 440 extends upwardly from the front flange 436 of the base plate 434 and aligns with an opening 444 (FIGS. 9 and 10) through the front armor plate 404 to provide a space 446, which accommodates the front leg 420 of the tripod 415. The armored hood 440 also provides a front brace for the front panel 404. The base 434 of the ballistic weapons stand 402 has the front portion 436 provided with a cutout 438 to save weight. The rear portion 450 of the base 434 has a cutout 454 between the rear flanges 430 and 432 so that the gunner does not have to stand on part of the ballistic weapons emplacement 402 and thus can be more isolated from vibrations due to firing the weapon. In order to rigidly secure the ballistics weapons stand 402 to the base 434, the hood is attached to the front armor plate 404 by extending edge portions 460 of the hood which are received through slots in the front armor plate 404 that are disposed adjacent to the periphery of the opening 444 in the front armor plate 404. The edge portions 460 extend through slots 462 in weld plates 464, which are preferably configured as straps. Stitch welds are then used to weld the edges portions 460 of the hood 440 to weld straps 464 in the same way the other embodiments weld front struts 120 to weld plates 160 (see FIG. 5).

Likewise, side struts 460 and 462 have lower ends thereof welded to base 434 at flanges 466 and 468 while having edge portions 470 and 472 project through slots in the side armor plates 406 and 408 and slots in weld plates 474 and 476. The welds between the edge portions 470 and 472 of the struts 462 and 464, respectively, are stitch welded to the weld strips 474 and 476 in the manner previously described.

As is best seen in FIG. 10, there are three U-shaped securing elements 480 disposed on the base 434 for securing the emplacement 402 on laterally extending beams or supports to which the U-shaped brackets are welded or bolted.

Figure 11:
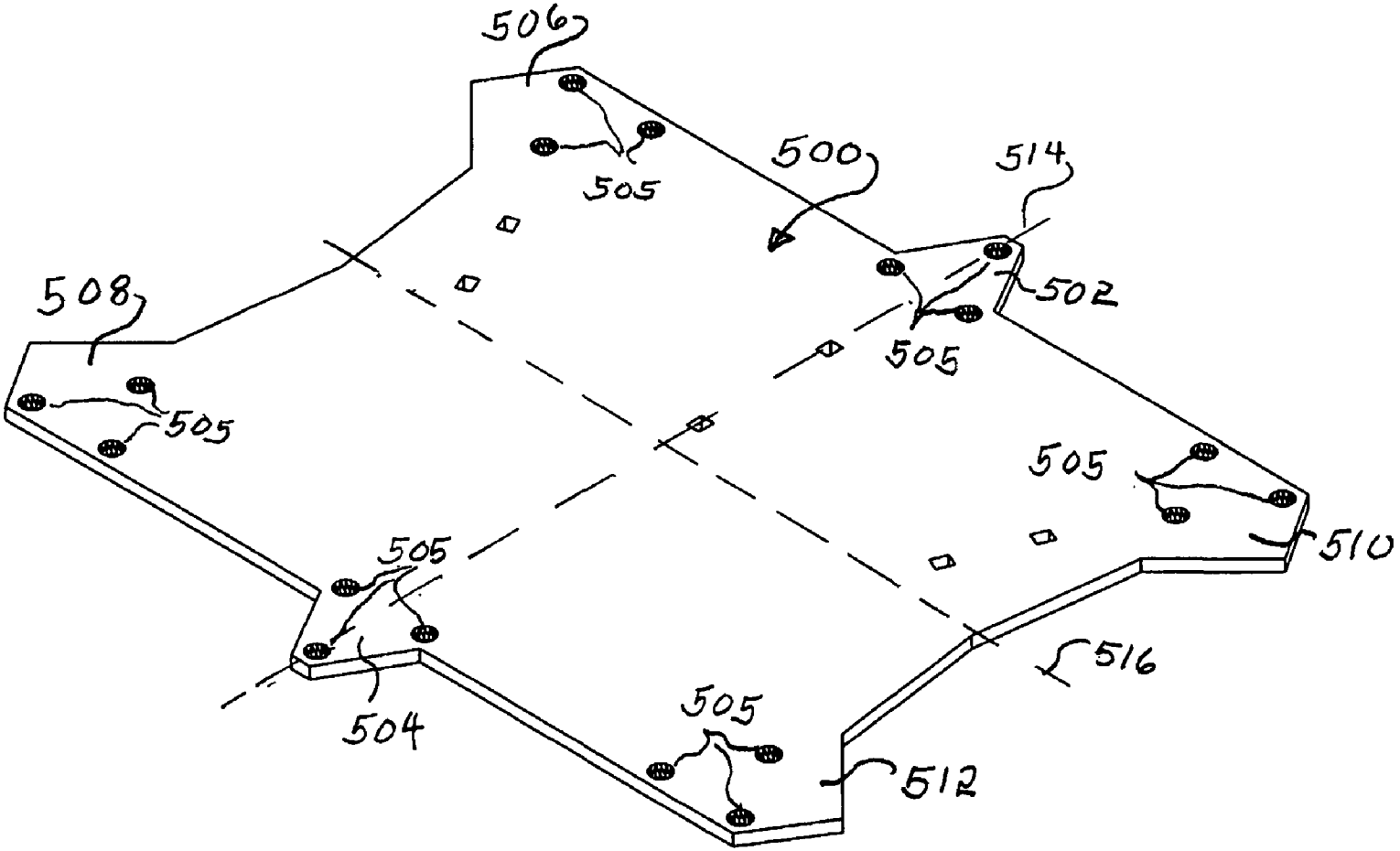
FIG. 11 is an enlarged top perspective view of a universal base.

Referring now to FIG. 11 there is shown a universal base 500 which has front central and back central mounting areas with bolt holes 505 therein preferably in the form of flanges 502 and 504 respectively; as well as front and rear left side mounting area preferably in the form of flanges 506 and 508 and front and rear right side flanges 510 and 512, respectively. The base 500 is symmetrical with respect to a front to rear center line 514 and with respect to a side to side center line 516. The flanges 502, 504, 506, 508, 510 and 512 are used to mount a tripod 518 (FIGS. 12-14) with either one leg forward and two legs rearward or two legs forward and one leg rearward.

Figure 12:
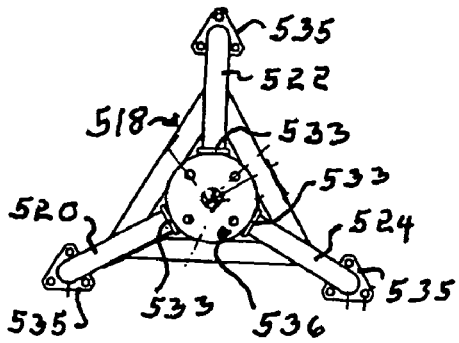
FIG. 12 is a top perspective view of a tripod which is mountable on the base of FIG. 11.
Figure 13:
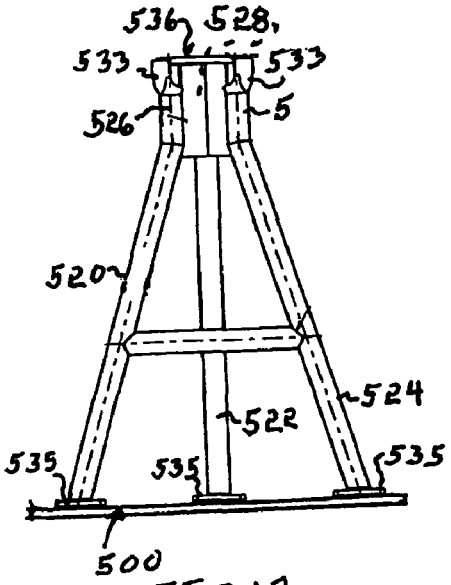
FIG. 13 is a rear view of the tripod of FIG. 12 when mounted on the base of FIG. 11 oriented with a single leg forward.
Figure 14:
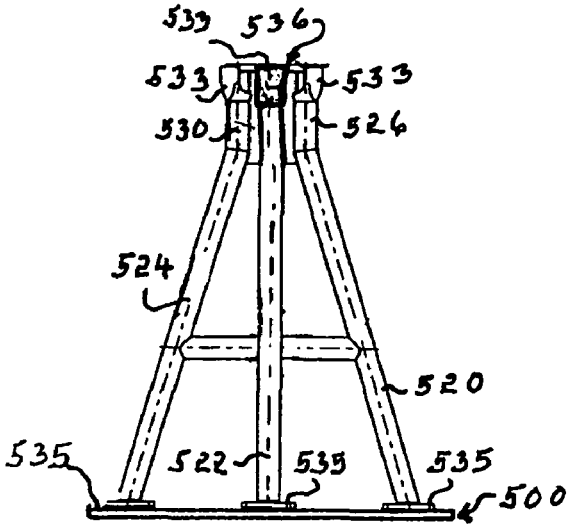
FIG. 14 is a rear view of the tripod of FIGS. 12 and 13 when mounted on the base of FIG. 11 with a pair of legs forward.

Referring now to FIGS. 12-14 the tripod 518 is similar to the tripod 415 of FIGS. 8-10. The tripod 518 has converging first, second and third legs 520, 522 and 524, respectively, which have upper portions 526, 528 and 530, each of which extend vertically from the lower portions. The upper portions 526, 528 and 530 each have a flange 533 which is welded to a platform 536 which supports a weapon such as the machine gun 11 of FIG. 1. Each of the legs 520, 522 and 524 have a foot pad 535 which is secured by bolts to a selected one of the flanges 502-512 of FIG. 11.

The tripod 518 of FIGS. 12, 13 and 14 is mounted on the base 500 of FIG. 11 with either one leg 522 extending forward and bolted through a foot pad 525 to the flange 502 and two legs 520 and 524 extending rearward and bolted through foot pads 535 to the flanges 508 and 512, as shown in FIG. 13, or with two legs 520 and 524 extending forward and bolted through foot pads 535 to the flanges 506 and 510 and one leg extending rearward and bolted through foot pad 535 to the flange 504, as shown in FIG. 14.

Figure 15:
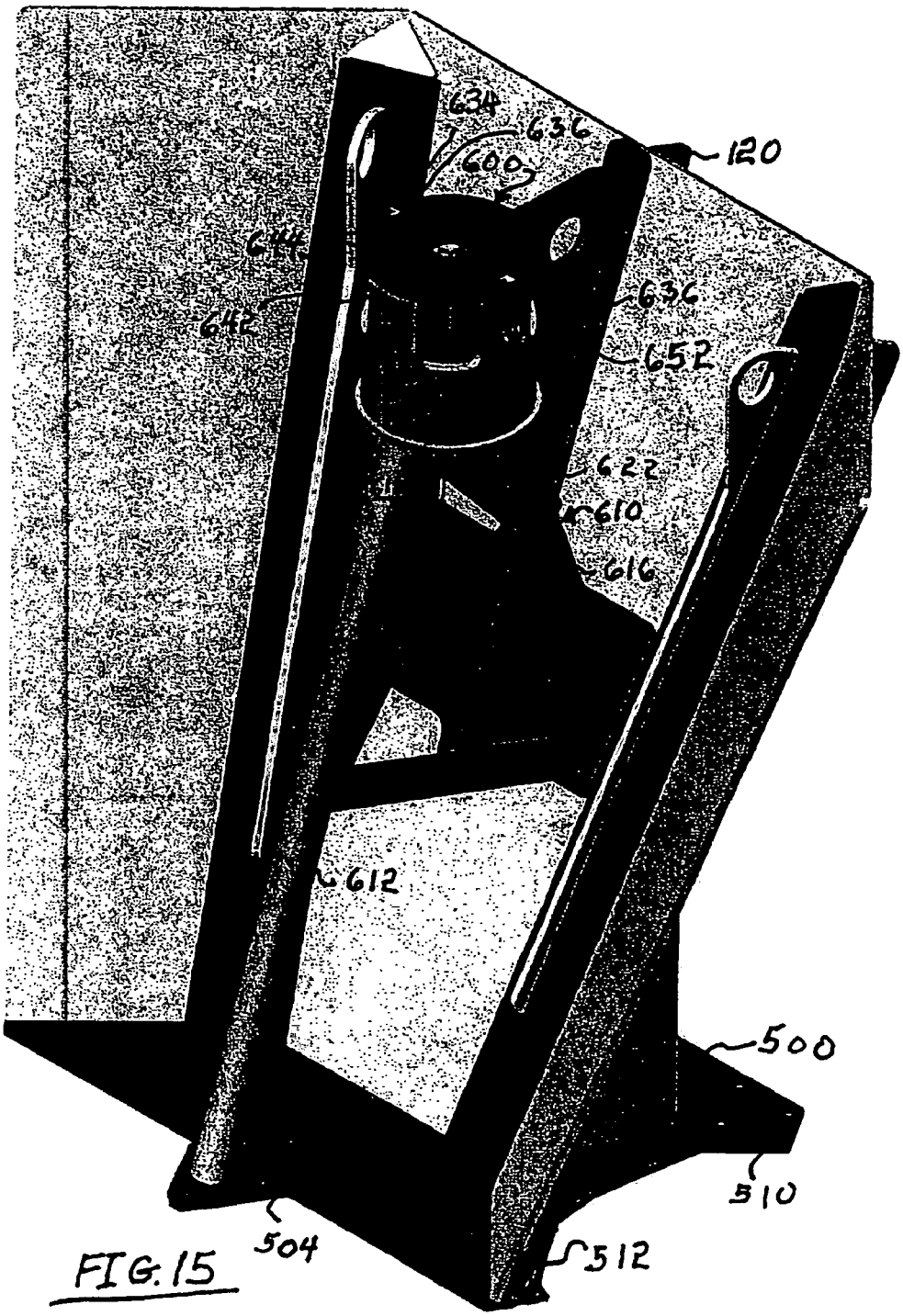
FIG. 15 is a top perspective view showing a tripod secured to a ballistic shield using the base of FIG. 11 and a mounting flange similar to FIGS. 6 and 7, wherein the tripod uses a second embodiment for a weapons mounting platform.
Figure 16:
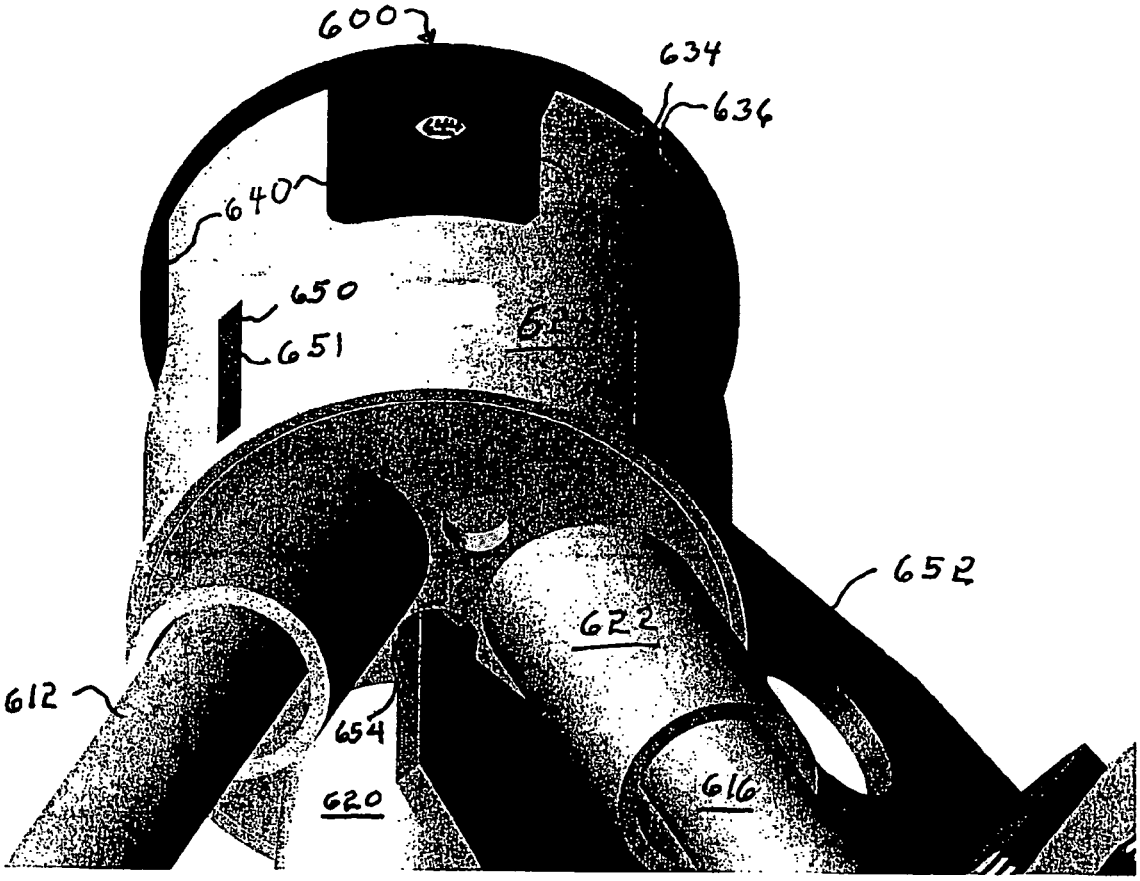
FIG. 16 is an enlarged top perspective view of the weapons mounting platform of FIG. 15.

Referring now to FIGS. 15 and 16 and there is shown an arrangement for mounting a weapons platform 600 on a tripod 610 wherein the tripod has legs 612, 614 and 616 which are straight. The legs 612, 614 and 616 are received in sleeves 618, 620 and 622 that are fixed to a slotted bracket 624 that supports the platform 600. In this way, the platform 600 is mounted on the tripod 610 by simply sliding the legs 612, 614 and 616 of the tripod into the sleeves 618, 620 and 622, preferably after the tripod is configured in accordance with the various embodiments disclosed therein. After the sleeves 618, 620 and 622 receive the legs 612, 614 and 616, the upper portions of the legs can simply rest in the sleeves, or optionally, the juncture between the legs and the sleeves may be welded or otherwise secured, for example by screws or the like.

The sleeves 618, 620 and 622 are welded or otherwise secured to a disk 630 at the bottom of a cylindrical bracket 624 while the platform 600 is positioned on the bracket 624 by locating tabs 634 in notches 636 at the periphery of the platform 600. The cylindrical bracket 624 has notches for 640 adjacent the top end 642 thereof which provide access to four bolts (not shown) projecting through holes 644 in the platform 600, so that nuts can be threaded on the bolts to fix a weapon (see 11, FIGS. 1 and 2) on the platform.

As is best seen in FIG. 16, at least one slot 650 is provided in the side wall of the cylindrical bracket 624 for receiving an end 651 of triangular a projection 652 that is a portion of a strut, such as the strut 120 of FIGS. 1-6. The triangular projection 652 also has a hook portion 654 that fits through an axial hole 656 in the bottom of disk 630.

From the foregoing description, one skilled in the art can easily ascertain the essential characteristics of this invention, and without departing form the spirit and scope thereof, can make various changes and modifications of the invention to adapt it to various usages and conditions.

I claim:

1. A fixed weapons emplacement comprising:

a ballistic weapons stand having a height sufficient to at least partially protect a standing gunner, the ballistic weapons stand including a base plate and at least one front armor plate connected to and extending vertically from the base plate, the at least one armor plate having a vertically extending front brace welded at a bottom end thereof to the base plate and secured to the at least one vertically extending armor plate to brace the at least one vertically extending armor plate, and a three point weapon support having a weapon mounting platform behind a rear surface of the front armor plate for mounting a weapon thereon which is movable with respect to the base plate and armor plate, the three point support having at least one rear leg fixed to the base plate and at least one front leg fixed adjacent to and fixed with respect to the front armor plate armor plate, with a third leg fixed to either the base plate or fixed adjacent to and fixed with respect to the front armor plate, each leg having an upper portion attached directly to the weapon mounting platform.

2. The fixed weapons emplacement of claim 1, wherein the front brace is a front strut and wherein a weld plate is positioned behind the front armor plate and stitch welded to the front strut, the front strut being welded to the base plate and passing through a slot in the front armor plate and the weld plate.

3. The fixed weapons emplacement of claim 2, wherein the three-point support is a tripod with two front legs fixed to the base and a rear leg welded to the weld plate.

4. The fixed weapons emplacement of claim 2 wherein the front brace is a front strut having a lower end fixed to the base plate and an upper portion extending through a slot in the front armor plate, and wherein a weld plate is located behind the front armor plate against the front armor plate, the weld plate being welded to the front strut and having at least one leg of the three point weapon support welded thereto.

5. The fixed weapons emplacement of claim 1 wherein the three point support comprises two rear legs fixed to the base plate for providing two support points and wherein a front strut projects behind the front armor plate providing the third leg of the three point weapon support.

6. The fixed weapons emplacement of claim 1 wherein the front brace has an opening therethrough defined by a perimeter, and wherein the base plate has a front portion extending in front of the opening, the front brace being a hood which is fixed to the base plate and to the front armor plate to enclose a space extending in front of the front armor plate, and the three-point support being a tripod having all three legs fixed to the base plate with at least one leg extending in the space enclosed by the hood in a direction up from the base to the platform.

7. The fixed weapons emplacement of claim 6 wherein the front armor plate has slots therein through which rear portions of the hood project, at least one weld plate being welded to the rear portions of the hood to attach the hood to the front armor plate.

8. The fixed weapons placement of claim 7 wherein the hood has sloping exterior surfaces to define a convex front surface and a concave rear surface.

9. The fixed weapons emplacement of claim 1 wherein the base plate supports the entire fixed weapons emplacement and the three point weapon support forms a tripod that mounts on the base plate with either, a pair of legs extending rearwardly from the front armor plate and secured to the base plate or one of the legs extending rearwardly and secured to the base plate.

10. The fixed weapons emplacement of claim 9 wherein the tripod has a foot pad on each of the three legs and the base plate has front central and back central mounting areas, front and rear right side mounting areas and front and rear left side mounting areas, which to three of the mounting areas the foot pads on the legs are secured.

11. The fixed weapons emplacement of claim 10 wherein the mounting areas on the base plate are defined by projecting flanges.

12. The fixed weapons emplacement of claim 1 wherein the weapon platform has weapon mounting holes therein and is fixed to a cylindrical mounting bracket having notches therein adjacent to the holes for facilitating mounting of a weapon on the weapons platform, the mounting bracket having a base with three sleeves extending downwardly at oblique angles thereto for receiving top portions of the legs comprising the three point support, the three point support being in the form of a tripod, the cylindrical bracket further having a slot therein for receiving a projection extending back from the armor plate, the projection being fixed in the slot to retain the weapon platform on the armor plate.

13. The fixed weapons emplacement of claim 1, wherein welds attach the upper portions of the legs to the weapons mounting platform.

14. A fixed weapons emplacement comprising:

a ballistic weapons stand for protecting a gunner, the ballistic weapons stand including a base plate and front armor plate fixed to the base plate and extending upwardly therefrom, a first side armor plate fixed to the base plate and extending upwardly therefrom and a second side armor plate fixed to the base plate and extending upwardly therefrom;

the front and side armor plates extending at an obtuse angle with respect to the gunner's position with the side armor plates being fixed to the front armor plate and extending laterally at an obtuse angle with respect to the front plate to define a protected space behind rear surfaces of the armor plate, and a three point weapon support having a weapon mounting platform behind a rear surface of the front armor plate for mounting a weapon thereon which is movable with respect to the base plate and armor plate, the three point support having at least one rear leg fixed to the base plate and at least one front leg fixed adjacent to and fixed with respect to the front armor plate armor plate, with a third leg fixed to either the base plate or fixed adjacent to and fixed with respect to the front armor plate, each leg having an upper portion attached directly to the weapon mounting platform.

15. The fixed weapon emplacement of claim 14 wherein a vertical axis extends through the platform on which the weapon is mounted and wherein the base plate extends horizontally forward in front of the vertical axis to provide stability to the ballistics weapons stand.

16. The fixed weapon emplacement of claim 14 wherein the front armor plate has a slot therein through which a reinforcing strut projects, the reinforcing strut being fixed to the base plate and to the front panel adjacent to the slot, the reinforcing strut having a support portion projecting beneath the weapons platform and fixed to the weapons platform.

17. The weapons platform of claim 16 wherein the armor plates have rear surfaces which are reinforced by additional armor plates adjacent slots therein.

18. The fixed weapons emplacement of claim 17 wherein the three point support is a tripod with one leg fixed to the base and two legs welded to the weld plate positioned on the rear surface of the front armor plate.

19. The fixed weapons emplacement of claim 17 wherein slots extend through the shield formed by the front and side armor plates at junctures of the front and side plates, the shield further including struts which are fixed to the base plate, extend through the slots and are welded to weld plates disposed behind the slots.

20. The fixed weapons emplacement of claim 14 wherein the three-point support has two legs fixed to the base plate and a third leg welded to a weld plate positioned on the rear surface of the front armor plate.

21. The fixed weapons emplacement of claim 20 wherein first and second bracing bars extend from a reinforcing weld plate to the two legs at locations intermediate the ends of the legs.

22. The fixed weapons emplacement of claim 21 wherein a third bracing bar is fixed between the two legs.

23. The fixed weapons emplacement of claim 14 wherein the three-point support for the weapon platform consists essentially of two legs having bottom ends fixed to the base plate and top ends fixed to the weapon platform with a reinforcing strut welded to the weld plate and to the weapons platform.

24. The fixed weapons emplacement of claim 14 wherein the weapon platform has weapon mounting holes therein and is fixed to a cylindrical mounting bracket having notches therein adjacent to the holes for facilitating mounting of a weapon on the weapons platform, the mounting bracket having a base with three sleeves extending downwardly at oblique angles thereto for receiving top portions of the legs comprising the three point support, the three point support being in the form of a tripod, the cylindrical bracket further having a slot therein for receiving a projection extending back from the armor plate, the projection being fixed in the slot to retain the weapon platform on the armor plate.

25. The fixed weapons emplacement of claim 14 wherein the weapon platform has weapon mounting holes therein and is fixed to a cylindrical mounting bracket having notches therein adjacent to the holes for facilitating mounting of a weapon on the weapons platform, the mounting bracket having a base plate with three sleeves extending downwardly at oblique angles thereto for receiving top portions of the legs comprising the tripod, the cylindrical bracket further having a slot therein for receiving a projection extending back from the armor plate, the projection being fixed in the slot to retain the weapon platform on the armor plate.

26. The fixed weapons emplacement of claim 14, wherein welds attach the upper portion of the legs to the weapons mounting platform.

* * * * *